US011539135B2

(12) United States Patent
Kim et al.

(10) Patent No.: US 11,539,135 B2
(45) Date of Patent: Dec. 27, 2022

(54) DISPLAY DEVICE

(71) Applicants: SAMSUNG ELECTRONICS CO., LTD., Suwon-si (KR); FOUNDATION FOR RESEARCH AND BUSINESS, SEOUL NATIONAL UNIVERSITY OF SCIENCE AND TECHNOLOGY, Seoul (KR)

(72) Inventors: Gyo Nyun Kim, Suwon-si (KR); Chang Won Jung, Seoul (KR); Jung-Jin Kim, Suwon-si (KR); Dong Hoon Lee, Suwon-si (KR)

(73) Assignees: SAMSUNG ELECTRONICS CO., LTD., Suwon-si (KR); FOUNDATION FOR RESEARCH AND BUSINESS, SEOUL NATIONAL UNIVERSITY OF SCIENCE AND TECHNOLOGY, Seoul (KR)

( * ) Notice: Subject to any disclaimer, the term of this patent is extended or adjusted under 35 U.S.C. 154(b) by 16 days.

(21) Appl. No.: 17/257,516

(22) PCT Filed: Jan. 10, 2019

(86) PCT No.: PCT/KR2019/000407
§ 371 (c)(1),
(2) Date: Dec. 31, 2020

(87) PCT Pub. No.: WO2020/009299
PCT Pub. Date: Jan. 9, 2020

(65) Prior Publication Data

US 2021/0376471 A1 Dec. 2, 2021

(30) Foreign Application Priority Data

Jul. 2, 2018 (KR) ..... 10-2018-0076427

(51) Int. Cl.

| | |
|---|---|
| ***H01Q 5/50*** | (2015.01) |
| ***H01Q 1/24*** | (2006.01) |
| ***H01Q 1/48*** | (2006.01) |
| ***H01Q 1/22*** | (2006.01) |
| ***H01Q 9/00*** | (2006.01) |

(52) U.S. Cl.
CPC ..... *H01Q 5/50* (2015.01); *H01Q 1/22* (2013.01); *H01Q 1/24* (2013.01); *H01Q 1/48* (2013.01); *H01Q 9/00* (2013.01)

(58) Field of Classification Search
CPC .. H01Q 5/50; H01Q 1/24; H01Q 1/22; H01Q 1/48; H01Q 9/00
(Continued)

(56) References Cited

U.S. PATENT DOCUMENTS

2004/0125026 A1* 7/2004 Pathak ..... H01Q 1/36 343/702
2011/0273348 A1 11/2011 Lopez et al.
(Continued)

FOREIGN PATENT DOCUMENTS

CN 101320838 A 12/2008
KR 10-2014-0148150 A 12/2014
KR 10-2015-0033398 A 4/2015

OTHER PUBLICATIONS

International Search Report (PCT/ISR/210) dated May 14, 2019 by the International Searching Authority in International Patent Application No. PCT/KR2019/000407.
(Continued)

*Primary Examiner* — Hai V Tran
(74) *Attorney, Agent, or Firm* — Sughrue Mion, PLLC

(57) ABSTRACT

The present disclosure relates to a display apparatus including a display panel, a bezel surface formed on a boundary of the display panel, and an antenna located on the bezel surface, wherein the antenna includes a composite right left
(Continued)

handed (CRLH) structure including a series inductor, a series capacitor, a parallel inductor, and a parallel capacitor.

11 Claims, 16 Drawing Sheets

(58) Field of Classification Search
USPC ..... 343/846
See application file for complete search history.

(56) References Cited

U.S. PATENT DOCUMENTS

| | | | | |
|---|---|---|---|---|
| 2012/0229347 | A1* | 9/2012 | Jin | H01Q 21/28 343/702 |
| 2013/0135157 | A1* | 5/2013 | Tsou | H04M 1/026 343/702 |
| 2014/0266922 | A1* | 9/2014 | Jin | H01Q 9/06 343/702 |
| 2014/0375513 | A1 | 12/2014 | Kang et al. | |
| 2016/0064812 | A1* | 3/2016 | Han | H01Q 9/42 343/702 |
| 2016/0322699 | A1* | 11/2016 | Mow | H01Q 13/10 |
| 2017/0033460 | A1* | 2/2017 | Ayala Vazquez | H01Q 1/245 |
| 2017/0288308 | A1 | 10/2017 | Wang et al. | |
| 2019/0081396 | A1* | 3/2019 | Zhou | H04M 1/02 |
| 2019/0097317 | A1* | 3/2019 | Di Nallo | H01Q 13/16 |

OTHER PUBLICATIONS

Written Opinion (PCT/ISR/237) dated May 14, 2019 by the International Searching Authority in International Patent Application No. PCT/KR2019/000407.

* cited by examiner

DISPLAY DEVICE

TECHNICAL FIELD

The present disclosure relates to a display apparatus, and more particularly, to a display apparatus including an antenna.

BACKGROUND ART

In general, a display apparatus is a type of output device that visually displays acquired or stored image information to a user, and is used in various fields such as a home and a business.

Recently, display panels displaying content in a display apparatus are having high resolution and becoming large in size. In addition, in a display apparatus, the thickness of a case including a top chassis and a bottom chassis covering the display panel is also getting thinner. That is, a display apparatus is designed to make the thickness of a bezel thin to increase image immersion of the user.

Recently, a digital television (TV) service using a wired or wireless communication network has become common. The digital TV service may provide various services that may not be provided in a conventional analog broadcasting service.

An antenna for receiving a signal is required in order to receive the digital TV service. As display apparatuses are getting slim, the location where an antenna is built into a display apparatus is very limited. Therefore, an external antenna is usually used or a separate external tuner is used.

DISCLOSURE

Technical Problem

The present disclosure is directed to providing a display apparatus capable of receiving a broadcast band signal having a broadband characteristic without a separate external device.

The present disclosure is directed to providing a display apparatus a display apparatus including an antenna capable of receiving a broadcast band signal having a broadband characteristic.

The present disclosure is directed to providing a display apparatus with an improved design.

The present disclosure is directed to providing a display apparatus with improved convenience of use.

The present disclosure is directed to providing a display apparatus capable of reducing a manufacturing cost.

Technical Solution

One aspect of the present disclosure provides a display apparatus including a display panel, a bezel surface formed on a boundary of the display panel, and an antenna located on the bezel surface, wherein the antenna includes a composite right left handed (CRLH) structure including a series inductor, a series capacitor, a parallel inductor, and a parallel capacitor.

The antenna may include a feeding body, and the series inductor may be provided in the feeding body.

The antenna may include a first radiation body configured to transmit and receive radio waves and a second radiation body spaced apart from the first radiation body by a first gap and configured to transmit and receive radio waves, and the first gap may be configured to form a series capacitance by the series capacitor.

The display apparatus may further include a bottom chassis configured to cover the rear of the display panel, wherein the antenna may include a ground body connected to the bottom chassis.

The bottom chassis may include a metal.

The ground body may include a first ground portion connected to the second radiation body, and the parallel inductor may be provided in the first ground portion.

The first radiation body may be connected to the feeding body.

At least a portion of the antenna may be located on at least one of an upper surface, a left surface, and a right surface of the bezel surface.

The feeding body, the first radiation body, and the second radiation body may be configured to be disposed on the same surface as the bezel surface.

The first radiation body and the second radiation body may be disposed to be spaced apart from the ground body by a second gap, and the second gap may be configured to form a parallel capacitance by the parallel capacitor.

The antenna may further include a broadband member disposed on the same plane as the feeding body, and the broadband member may include a first CPW body disposed on one side of the feeding body to be spaced apart by a third gap, and a second CPW body disposed on the other side opposite to one side of the feeding body to be spaced apart by a fourth gap.

The first CPW body and the second CPW body may extend in the same direction as the feeding body.

The ground body may include a second ground portion connected to the broadband member.

Another aspect of the present disclosure provides a display apparatus including a display panel, a bezel surface formed on a boundary of the display panel, and an antenna located on the bezel surface and including a CRLH structure, wherein the antenna includes a feeding body to which current is supplied, and a broadband member disposed on the same plane as the feeding body, extending along a circumferential direction of the feeding body, and disposed to be spaced apart from the feeding body by a predetermined distance.

The display apparatus may further include a bottom chassis including metal, the antenna may include a ground body connected to the bottom chassis, and the broadband member may be connected to the ground body.

The antenna may include a radiation body having one end connected to the feeding body and the other end connected to the ground body and configured to transmit and receive radio waves.

The ground body may include a first ground portion connected to the radiation body and a second ground portion connected to the broadband member.

The broadband member may include a first CPW body disposed on one side of the feeding body and extending in the same direction as the feeding body, and a second CPW body disposed on the other side opposite to one side of the feeding body and extending in the same direction as the feeding body.

The feeding body and the radiation body may be configured to be disposed on the same surface as the bezel surface.

Another aspect of the present disclosure provides a display apparatus including a display panel, a bezel surface formed on a boundary of the display panel, a bottom chassis configured to cover the rear of the display panel, and an antenna located on the bezel surface and including a CRLH structure, wherein the antenna includes a feeding body provided with a series inductor, a radiation member connected to the feeding body and configured to transmit and receive radio waves, and a ground body connecting the radiation member and the bottom chassis and provided with a parallel inductor.

Advantageous Effects

In a display apparatus according to the present disclosure, an antenna capable of receiving a broadcast band signal having a broadband characteristic is integrally provided on one side of a bezel of the display apparatus, so that the signal can be received without a separate external device.

The display apparatus according to the present disclosure includes an antenna having a composite right left handed (CRLH) structure, so that a signal of a wider band width can be received.

In the display apparatus according to the present disclosure, an antenna is provided integrally on the bezel, so that the design thereof can be improved.

The display apparatus according to the present disclosure does not require a separate external device for receiving a broadcast band signal having a broadband characteristic, so that convenience of use can be improved.

In the display apparatus according to the present disclosure, an antenna having a relatively simple configuration is provided integrally on the bezel, instead of a separate external device for receiving a broadcast band signal having a broadband characteristic, so that a manufacturing cost can be reduced.

MODE OF THE DISCLOSURE

Like reference numbers or signs in the various drawings of the application represent parts or components that perform substantially the same functions. This specification does not describe all elements of the embodiments, and the general contents in the technical field to which the present disclosure belong or the overlapping contents between the embodiments are omitted. The terms 'portion,' 'part,' and 'member' used in the specification may be implemented by software or hardware, and according to embodiments, a plurality of 'portions,' 'parts,' and 'members' may be implemented as one component, or one 'portion,' 'part,' and 'member' may include a plurality of components.

Throughout the specification, when a portion is described as being "connected" to another portion, this includes the case of being indirectly connected as well as being connected directly, and the indirect connection includes connecting through a wireless communication network.

When a portion is described as "comprising" a component, this means that other components may be further included rather than excluding other components unless otherwise specified.

Throughout the specification, when a member is described as being positioned "above" another member, this includes not only the case where one member is in contact with another member, but also the case where another member exists between the two members.

The terms first, second, etc. are used to distinguish one component from other components, and the component is not limited by these terms.

The singular expressions herein may include plural expressions, unless the context clearly dictates otherwise.

In each step, the identification number is used for convenience of description, and the identification number does not describe the order of each step. Each step may be performed differently from the specified order, unless a specific order is explicitly described in the context.

Hereinafter, principles and embodiments of the present disclosure will be described with reference to the accompanying drawings.

Figure 1:
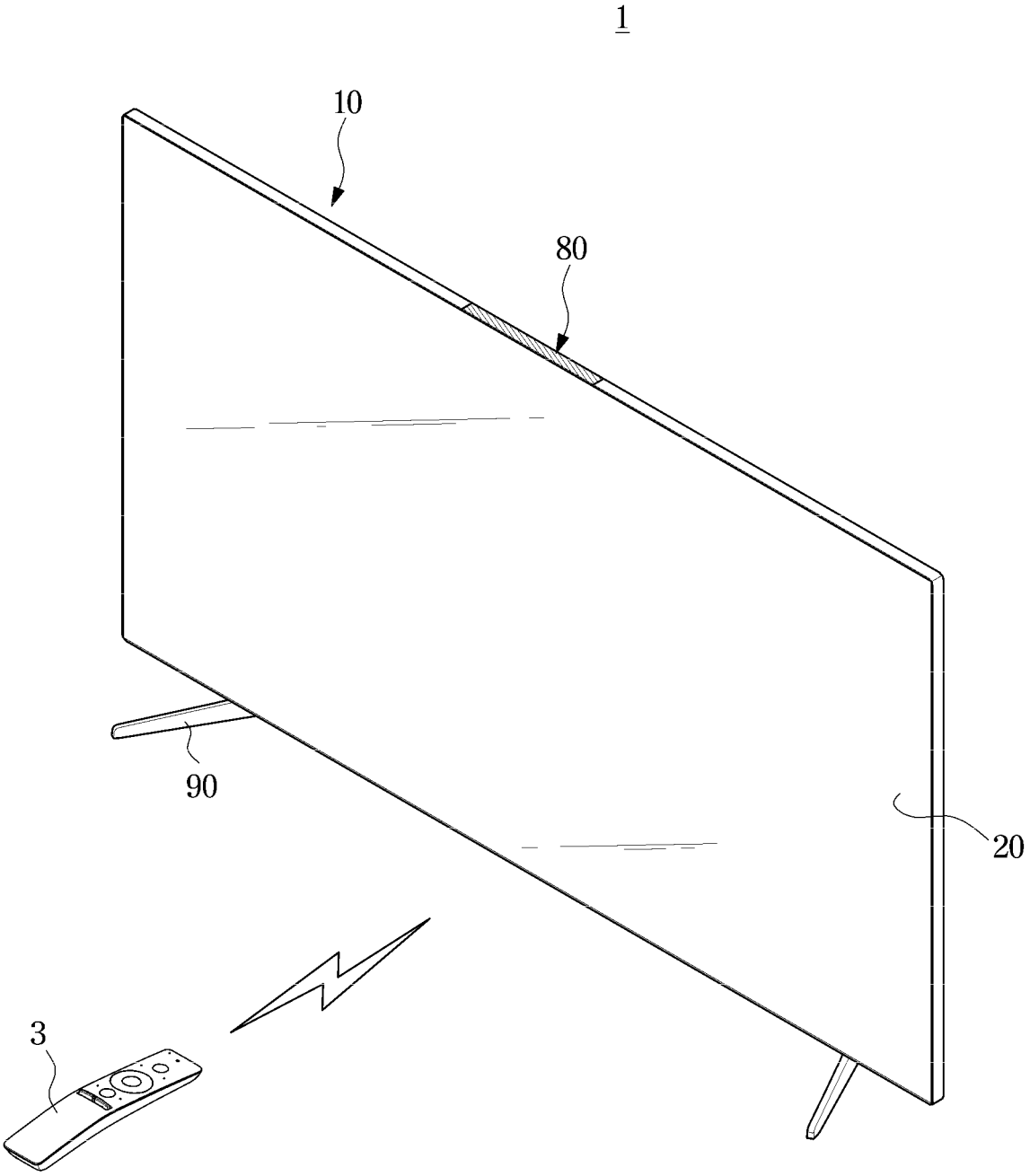
FIG. 1 illustrates an outer appearance of a display apparatus according to an embodiment of the present disclosure.
Figure 2:
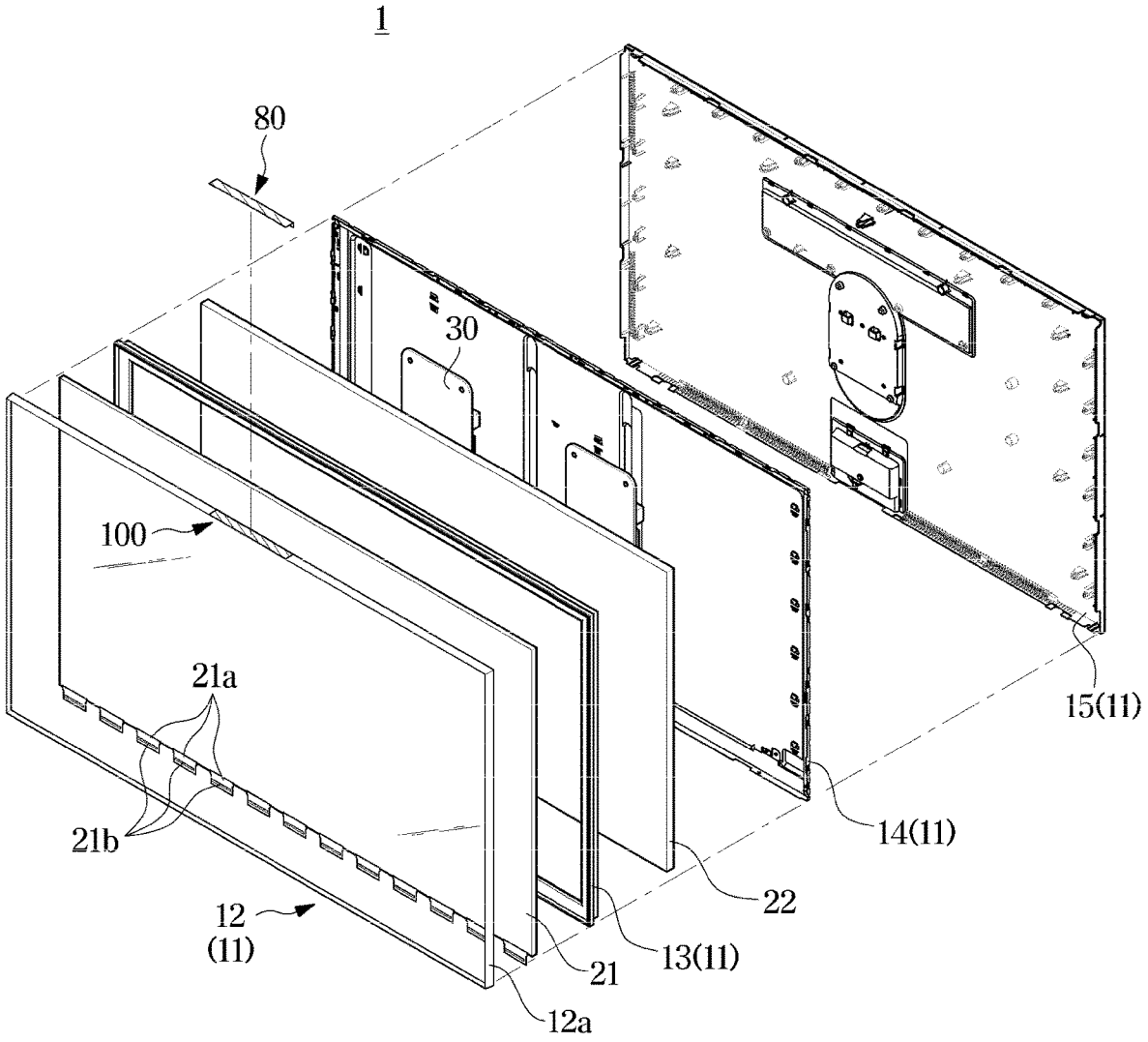
FIG. 2 is an exploded view of the display apparatus illustrated in FIG. 1.

FIG. 1 illustrates an outer appearance of a display apparatus according to an embodiment of the present disclosure. FIG. 2 is an exploded view of the display apparatus illustrated in FIG. 1.

A display apparatus 1 is a device capable of processing an image signal received from the outside and visually displaying the processed image. Hereinafter, the case where the display apparatus 1 is a television (TV) is illustrated, but is not limited thereto. For example, the display apparatus 1 may be implemented in various forms such as a monitor, a portable multimedia device, a portable communication device, and a portable computing device, and when the display apparatus 1 is a device that visually displays an image, a form thereof is not limited.

Also, the display apparatus 1 may be a large format display (LFD) installed outdoors, such as a roof of a building and a bus stop. The outdoors are not necessarily limited to the outside, and the display apparatus 1 according to an embodiment of the present disclosure may be installed in a place where a large number of people may enter or exit even in an indoor environment, such as a subway station, a shopping mall, a movie theater, a company, a shop, and the like.

The display apparatus 1 may receive a video signal and an audio signal from various content sources and output video and audio corresponding to the video signal and the audio signal. For example, the display apparatus 1 may receive content from a content playback device, or receive content from a content providing server of a content provider.

As illustrated in FIG. 1, the display apparatus 1 may include a main body 10, a screen 20 displaying an image, a support 90 provided below the main body 10 to support the main body 10, and an input device 3 transmitting a signal to the display apparatus 1.

The main body 10 forms an outer shape of the display apparatus 1, and components necessary for the display apparatus 1 to display an image may be provided inside the main body 10. FIG. 1 illustrates that the main body is formed in a flat plate shape, but the shape of the main body is not limited to that illustrated in FIG. 1. For example, the main body may have a shape in which both right and left ends protrude forward and the center thereof is concave.

The screen 20 is formed on a front surface of the main body 10, and an image that is visual information may be displayed on the screen 20. For example, a still image or a video may be displayed on the screen 20, and a 2D flat image or a 3D stereoscopic image may be displayed.

A plurality of pixels is formed on the screen 20, and an image displayed on the screen 20 may be formed by a combination of light emitted from the plurality of pixels. For example, one image may be formed on the screen 20 by combining light emitted from a plurality of pixels like a mosaic.

Each of the plurality of pixels may emit light of various levels of brightness and various colors.

In order to emit light of various levels of brightness, each of the plurality of pixels may include a configuration (e.g., an organic light emitting diode) capable of directly emitting light, or may include a configuration (e.g., a display panel) capable of transmitting or blocking light emitted by the backlight unit and the like.

In order to emit light of various colors, each of the plurality of pixels may include subpixels.

The subpixels may include a red subpixel capable of emitting red light, a green subpixel capable of emitting green light, and a blue subpixel capable of emitting blue light. For example, red light may exhibit light having a wavelength of about 620 nm (nanometer, one billionth of a meter) to 750 nm, green light may exhibit light having a wavelength of about 495 nm to 570 nm, and blue light may exhibit light having a wavelength of about 450 nm to 495 nm.

By a combination of red light of the red subpixel, green light of the green subpixel and blue light of the blue subpixel, each of the plurality of pixels may emit light having various levels of brightness and various colors.

FIG. 1 illustrates that the screen 20 is formed in a flat plate shape, but the shape of the screen 20 is not limited to that illustrated in FIG. 1. For example, according to the shape of the main body 10, the screen 20 may have a shape in which both right and left ends protrude forward and the center thereof is concave.

An antenna cover 80 provided to cover a portion corresponding to an antenna 100, which will be described later, may be coupled to an upper surface of the main body 10. The position of the antenna cover 80 is not limited thereto, but the antenna cover 80 may be coupled to a left surface of the main body 10 when the antenna 100 is provided on the left surface of the main body 10 and may be coupled to a right surface of the main body 10 when the antenna 100 is provided on the right surface of the main body 10.

The support 90 is installed below the main body 10 such that the main body 10 may maintain a stable posture on a floor surface. Alternatively, the support 90 may be installed on a rear surface of the main body 10 such that the main body 10 may be securely fixed to a wall surface.

The input device 3 may be configured to allow a user to input a desired command into the display apparatus 1.

As illustrated in FIG. 2, various components for generating an image on the screen 20 may be provided inside the main body 10.

For example, the main body 10 is provided with a backlight unit 22 configured to emit surface light forward, a display panel 21 configured to block or transmit light emitted from the backlight unit 22, and a power supply/control unit 30 configured to control the operation of the backlight unit 22 and the display panel 21. Also, the main body 10 may be provided with a case 11 configured to support and fix the display panel 21, the backlight unit 22 and the power supply/control unit 30. The case 11 may include a bezel 12, a frame middle mold 13, a bottom chassis 14, and a rear cover 15. The display panel 21 may be mounted on the case 11.

The bezel 12 may be disposed to cover a circumference of the display panel 21. The bezel 12 may have a width in a front-rear direction of about 1.5 cm. The bezel 12 may include a metal. The bezel 12 may include a bezel surface **12*a* formed at a boundary of the display panel 21. The bezel surface 12*a* may include an upper surface, a lower surface, a left surface, and a right surface of the bezel 12**.

The bottom chassis 14 may be disposed to cover the rear of the display panel 21. The bottom chassis 14 may be grounded with the antenna 100 to serve as ground. To this end, the bottom chassis 14 may include a metal.

The backlight unit 22 may include a point light source emitting monochromatic light or white light and may refract, reflect, and scatter light to convert light emitted from the point light source into uniform surface light.

For example, the backlight unit 22 may include a light source emitting monochromatic light or white light, a light guide plate through which light is incident from the light source and the incident light is diffused, a reflective sheet reflecting the light emitted from a rear surface of the light guide plate, and an optical sheet refracting and scattering light emitted from a front surface of the light guide plate.

As such, the backlight unit 22 may emit uniform surface light toward the front by refracting, reflecting, and scattering light emitted from the light source.

The display panel 21 is provided in the front of the backlight unit 22 and blocks or transmits light emitted from the backlight unit 22 to form an image.

A front surface of the display panel 21 forms the screen 20 of the display apparatus 1 described above and may be composed of the plurality of pixels. The plurality of pixels included in the display panel 21 may independently block or transmit light from the backlight unit 22, and light transmitted by the plurality of pixels may form an image displayed on the display apparatus 1.

The power supply/control unit 30 may include a power supply circuit to supply power to the backlight unit 22 and the display panel 21, and a control circuit to control the operation of the backlight unit 22 and the display panel 21.

The power supply circuit may supply power to the backlight unit 22 so that the backlight unit 22 may emit surface light and may supply power to the display panel 21 so that the display panel 21 may transmit or block light.

The control circuit may control the backlight unit 22 to adjust the intensity of light emitted from the backlight unit 22 and may control the display panel 21 to display an image on the screen 20.

For example, the control circuit may control the display panel 21 to display an image by a video signal received from content sources. Each of the plurality of pixels included in the display panel 21 transmits or blocks light according to image data of the control circuit, and as a result, an image is displayed on the screen 20.

The power supply/control unit 30 may be implemented with a printed circuit board and various circuits mounted on the printed circuit board. For example, the power supply circuit may include a capacitor, a coil, a resistance element, a microprocessor, and the like, and a power supply circuit board on which these components are mounted. The control circuit may include a memory, a microprocessor and a control circuit board on which these components are mounted.

A cable 21*a* to transmit image data from the power supply/control unit 30 to the display panel 21 and a display driver integrated circuit (DDI) 21*b* (hereinafter referred to as a 'display drive unit') to process the image data are provided between the display panel 21 and the power supply/control unit 30.

The cable 21*a* may electrically connect the power supply/control unit 30 and the display drive unit 21*b* and may electrically connect the display drive unit 21*b* and the display panel 21.

The display drive unit 21*b* may receive image data from the power supply/control unit 30 through the cable 21*a* and may transmit the image data to the display panel 21 through the cable 21*a*.

The cable 21*a* may be implemented as a film cable that may be bent by an external force, and the cable 21*a* and the display drive unit 21*b* may be integrally implemented by a film cable, a chip on film (COF), a tape carrier packet (TCP), and the like. In other words, the display drive unit 21*b* may be disposed on the cable 21*a*. However, the present disclosure is not limited thereto, and the display drive unit 21*b* may be disposed on the display panel 21.

Figure 3:
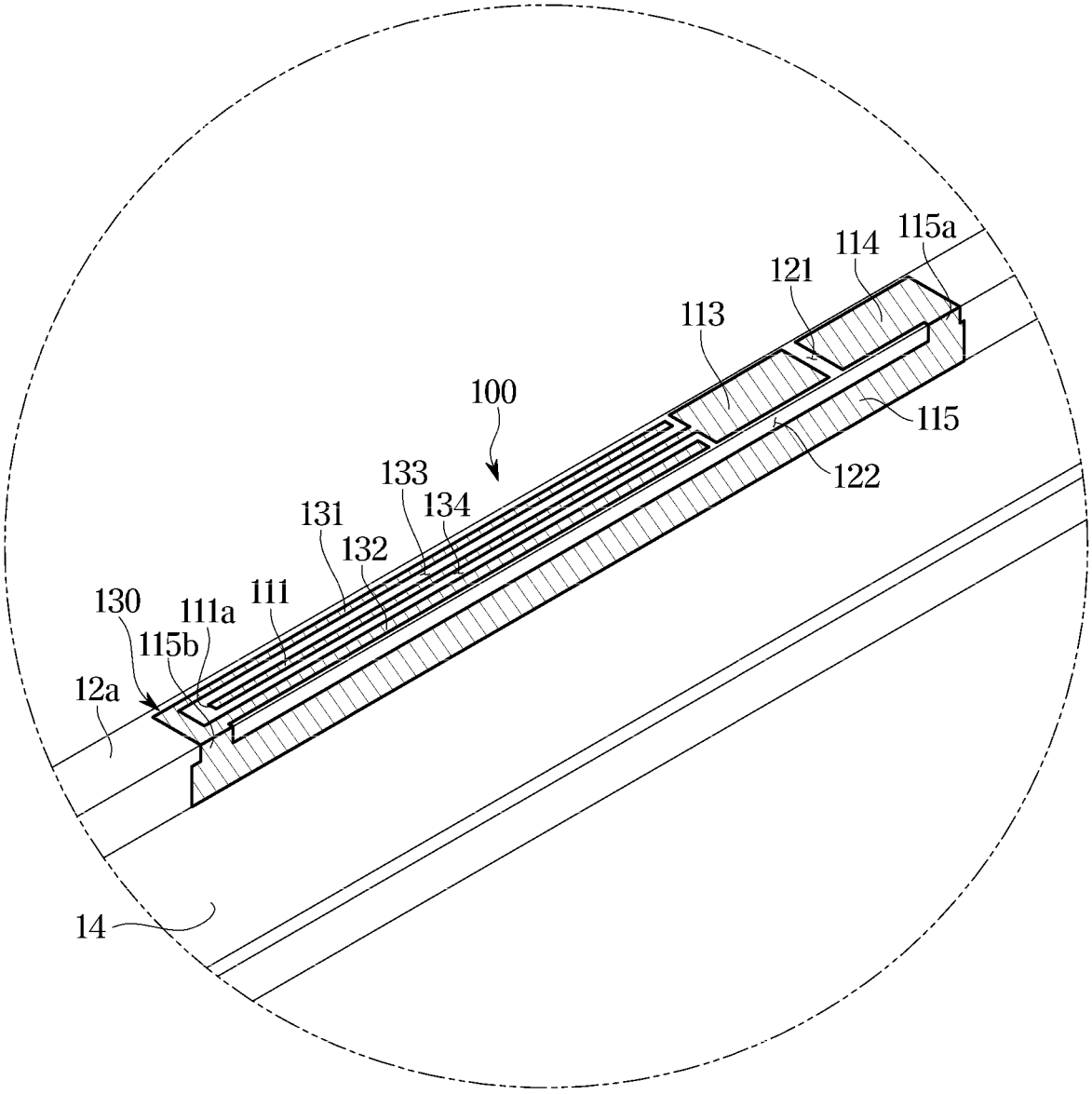
FIG. 3 is a rear view of an antenna formed integrally on a bezel illustrated in FIG. 2.
Figure 4:
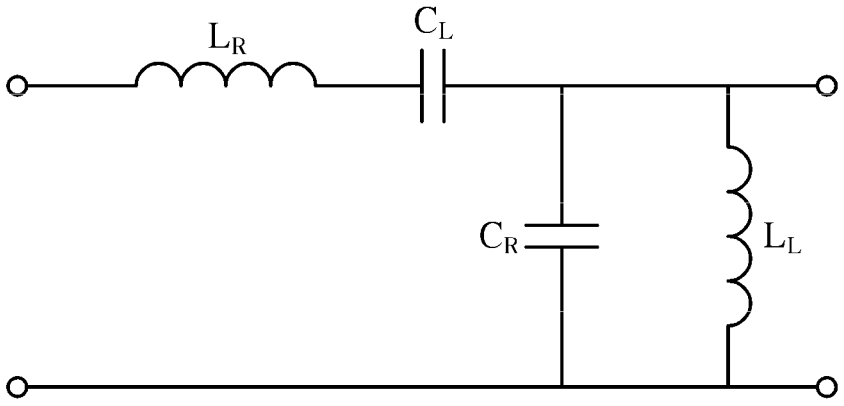
FIG. 4 is a circuit diagram illustrating an equivalent circuit of the antenna illustrated in FIG. 3.
Figure 5:
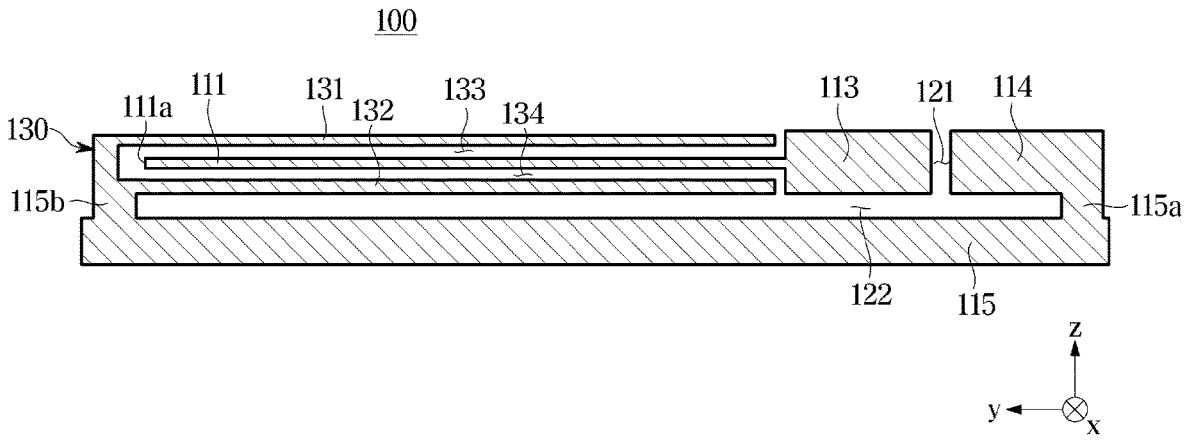
FIG. 5 is a plan view of the antenna in an unfolded state illustrated in FIG. 3.

FIG. 3 is a rear view of an antenna formed integrally on a bezel illustrated in FIG. 2. FIG. 4 is a circuit diagram illustrating an equivalent circuit of the antenna illustrated in FIG. 3. FIG. 5 is a plan view of the antenna in an unfolded state illustrated in FIG. 3.

Referring to FIG. 3, the antenna 100 may be integrally formed on a circumferential surface of the bezel 12. The antenna 100 may integrally form a pattern thereof on the circumferential surface of the bezel 12. Alternatively, the antenna 100 may be detachably mounted on the bezel 12. The antenna 100 may include a metal. The antenna 100 may be formed in a flat plate shape. The antenna 100 may be located on the bezel surface 12*a*. Specifically, the antenna 100 may be integrally formed on the upper surface of the bezel 12. Alternatively, the antenna 100 may be integrally formed on a left surface and/or a right side surface of the bezel 12.

Referring to FIGS. 4 and 5, the antenna 100 may include a composite right left handed (CRLH) structure. The CRLH structure is composed of a structure of combining a right handed (RH) structure, which indicates a general characteristic in which propagation directions of electric fields, magnetic fields, and electromagnetic waves follow the right-hand rule, and a left handed (LH) structure, which indicates a characteristic in which propagation directions of electric fields, magnetic fields, and electromagnetic waves follow the left-hand rule as opposed to the right-hand rule. By adding LH elements (series capacitors and parallel inductors), the antenna 100 may have both LH transmission characteristics and RH transmission characteristics. That is, the antenna 100 may implement a broadband characteristic using a transmission line of the CRLH structure.

A zeroth-order resonance characteristic appears at a frequency at which permittivity and permeability become zero between a LH transmission band and a RH transmission band. The antenna 100 having the zero-order resonance characteristic may determine resonance and radiation characteristics by adjusting values of the inductors and capacitors of the CRLH structure. That is, the resonance and radiation characteristics of the antenna 100 may be independent of the physical length of the antenna 100. Accordingly, the antenna 100 may be downsized.

The CRLH structure is a transmission circuit of a metamaterial structure. The metamaterial refers to a material or electromagnetic structure synthesized by an artificial method to exhibit special electromagnetic properties that are not commonly found in nature. This metamaterial has negative permittivity and permeability under certain conditions, and exhibits electromagnetic wave transmission characteristics different from general materials or electromagnetic structures. In this metamaterial structure, the relationship between the phase constant of an electromagnetic wave and a frequency band is nonlinear, and the characteristic curve thereof may exist on the left half of a coordinate plane.

Specifically, referring to FIG. 4, the antenna 100 including the CRLH structure may include a series inductor $L_R$, a series capacitor $C_L$, a parallel inductor $L_L$, and a parallel capacitor $C_R$. The series inductor $L_R$ and the series capacitor $C_L$ are connected in series, and the parallel inductor $L_L$ and the parallel capacitor $C_R$ are connected in parallel to the series inductor $L_R$ and the series capacitor $C_L$, respectively. The series inductor $L_R$ and the parallel capacitor $C_R$ are arranged in the RH structure, and the series capacitor $C_L$ and the parallel inductor $L_L$ are arranged in the LH structure.

Specifically, referring to FIG. 5, the antenna 100 may include a feeding body 111, radiation bodies 113 and 114, and a ground body 115.

An end 111*a* of the feeding body 111 may be connected to a feeding means (not shown). The feeding body 111 may receive current from the feeding means and guide the current to the radiation body 113. The series inductor $L_R$ may be provided in the feeding body 111. Accordingly, a series inductance may be formed in the feeding body 111.

The radiation bodies 113 and 114 may include the first radiation body 113 connected to the feeding body 111 and the second radiation body 114 connected to the ground body 115. The first radiation body 113 and the second radiation body 114 may emit radio waves or receive radio waves. The first radiation body 113 and the second radiation body 114 may resonate when current is supplied to the feeding body 111. The first radiation body 113 and the second radiation body 114 may resonate in a specific frequency band and may transmit and receive electromagnetic waves corresponding to the corresponding frequency band.

A first gap 121 may be formed between the first radiation body 113 and the second radiation body 114. A series capacitance may be formed by the series capacitor $C_L$ in the first gap 121.

The ground body 115 may be connected to the bottom chassis 14 so that the antenna 100 is grounded. The ground body 115 may be attached to a portion of the bezel 12 adjacent to the bottom chassis 14. The ground body 115 may include a first ground portion 115*a* connected to the second radiation body 114 and a second ground portion 115*b* connected to a broadband member 130.

The parallel inductor $L_L$ may be provided in the first ground portion 115*a*. The parallel inductor $L_L$ may form a parallel inductance. The parallel inductor $L_L$ may connect the feeding body 111 and the bottom chassis 14, which is the ground, to form a shunt inductance.

A second gap 122 may be formed between the radiation bodies 113 and 114 and the ground body 115. A parallel capacitance may be formed by the parallel capacitor $C_R$ in the second gap 122.

The broadband member 130 may form a coplanar waveguide (CPW) structure together with the feeding body 111. Specifically, the broadband member 130 may include a first CPW body 131 and a second CPW body 132 parallel to the feeding body 111. The first CPW body 131 and the second CPW body 132 may extend in the same direction as the feeding body 111. Accordingly, a third gap 133 may be formed between the feeding body 111 and the first CPW body 131, and a fourth gap 134 may be formed between the feeding body 111 and the second CPW body 132. The third gap 133 and the fourth gap 134 may have the same width.

The broadband member 130 may be connected to the second ground portion 115*b* of the ground body 115 to be grounded. The antenna 100 may have a broadband characteristic because the first CPW body 131 and the second CPW body 132 connected to the ground body 115 are disposed on the same plane as the feeding body 111. That is, the antenna 100 according to an embodiment of the present disclosure is easy to manufacture by using a CPW feeding structure, and may obtain a broadband impedance bandwidth.

According to this configuration, the display apparatus 1 according to an embodiment of the present disclosure may receive a wideband signal through the antenna 100 integrally formed on the bezel 12 without a separate external device. The antenna 100 according to an embodiment of the present disclosure may operate at the entire frequencies of an ultra-high frequency (UHF) broadcast band through the CRLH structure and the CPW feeding structure. The antenna 100 according to an embodiment of the present disclosure may receive a signal in a frequency band of about 450 MHz or more and 770 MHz or less.

Figure 6:
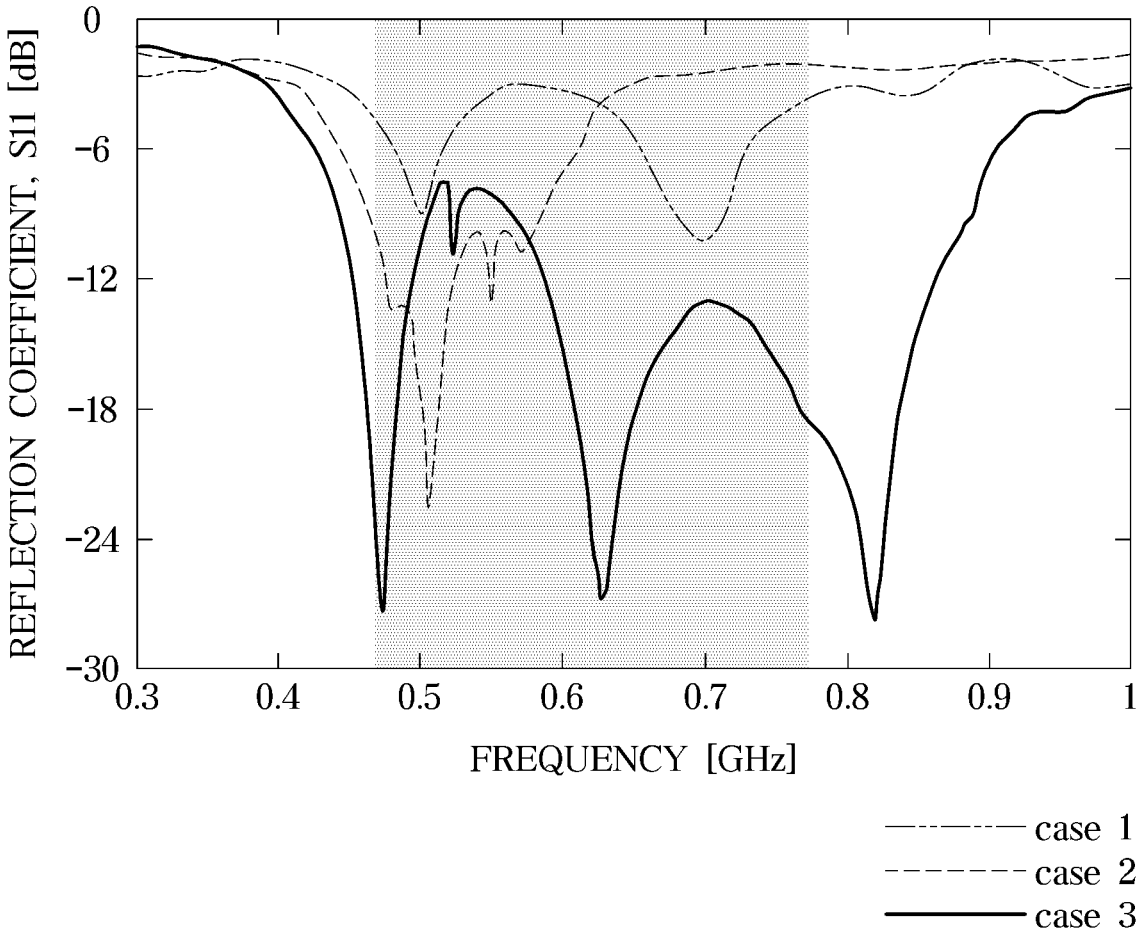
FIG. 6 is a graph schematically illustrating operating frequency bands of various antennas including the antenna illustrated in FIG. 3.

FIG. 6 is a graph schematically illustrating operating frequency bands of various antennas including the antenna illustrated in FIG. 3.

Referring to FIG. 6, the antennas illustrated in FIGS. 3 to 5 may operate at the entire frequencies of the UHF broadcast band as in case 3.

On the other hand, the antenna 100 operates as in case 2 when the broadband member 130 is omitted. That is, the antenna 100 operates as in case 2 when the second ground portion 115*b* is omitted. In other words, when the broadband member 130 is omitted, the antenna 100 may not operate at the entire frequencies of the UHF broadcast band. When the broadband member 130 is omitted, the antenna 100 operates only in a low frequency band.

Also, the antenna 100 operates as in case 1 when the broadband member 130 and the parallel inductor are omitted. That is, the antenna 100 operates as in case 1 when the second ground portion 115*b* and the first ground portion 115*a* are omitted. In other words, when the broadband member 130 and the parallel inductance structure are omitted, the antenna 100 may not operate at the entire frequencies of the UHF broadcast band.

FIGS. 7 to 12 are graphs illustrating various radiation patterns of the antenna illustrated in FIG. 3. In describing the graphs shown in FIGS. 7 to 12, an x direction, a y direction, and a z direction illustrated in FIG. 5 are used. The x direction may be defined as an up-down direction of the display apparatus 1, and they direction may be defined as a left-right direction of the display apparatus 1, and the z direction may be defined as a front-rear direction of the display apparatus 1.

Figure 7:
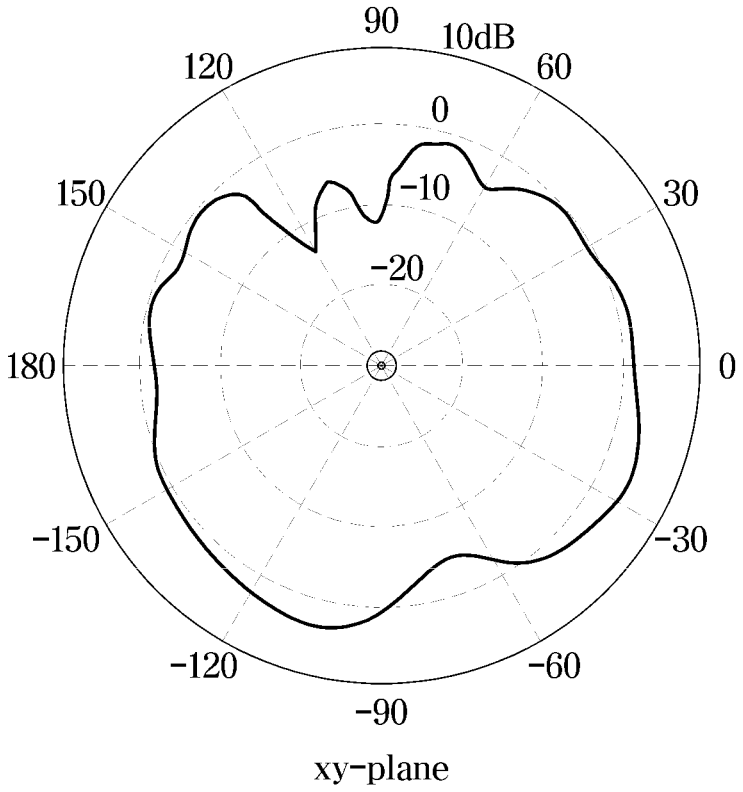
FIGS. 7 to 12 are graphs illustrating various radiation patterns of the antenna illustrated in FIG. 3.
Figure 8:
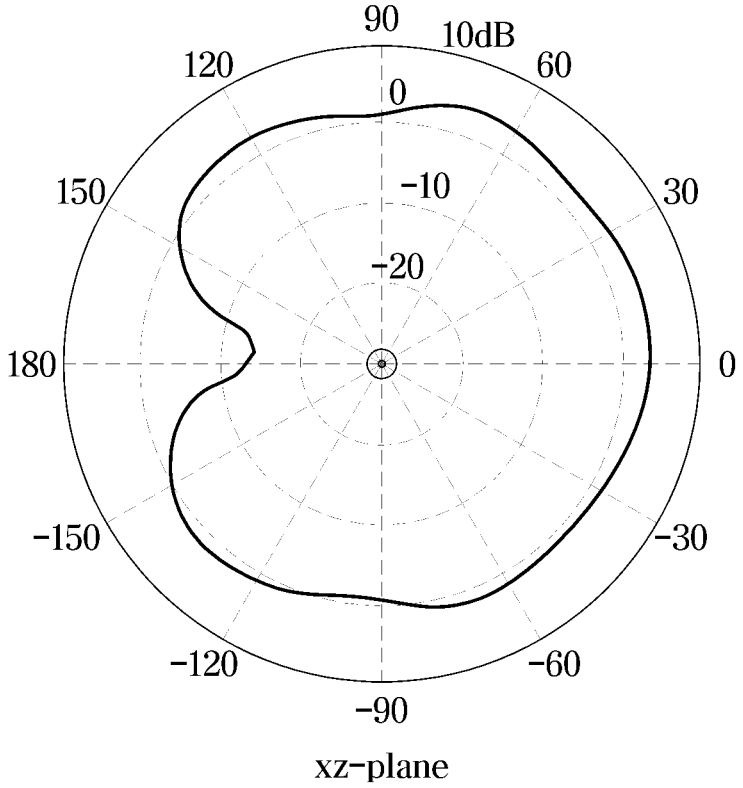

FIGS. 7 and 8 are graphs illustrating radiation patterns of the antenna 100 when operating at a frequency of 470 MHz. Specifically, FIG. 7 illustrates a radiation pattern along a xy plane indicated in FIG. 5, and FIG. 8 illustrates a radiation pattern along an xz plane indicated in FIG. 5. The antenna 100 according to an embodiment of the present disclosure may have a radiation pattern directing to all directions (i.e., all directions from 0 to 360 degrees).

Figure 9:
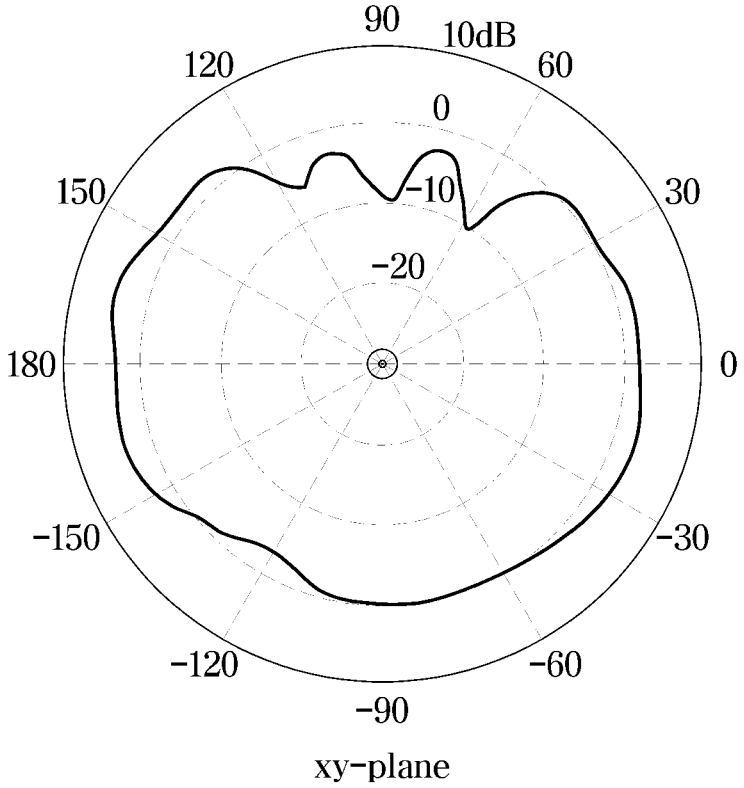
Figure 10:
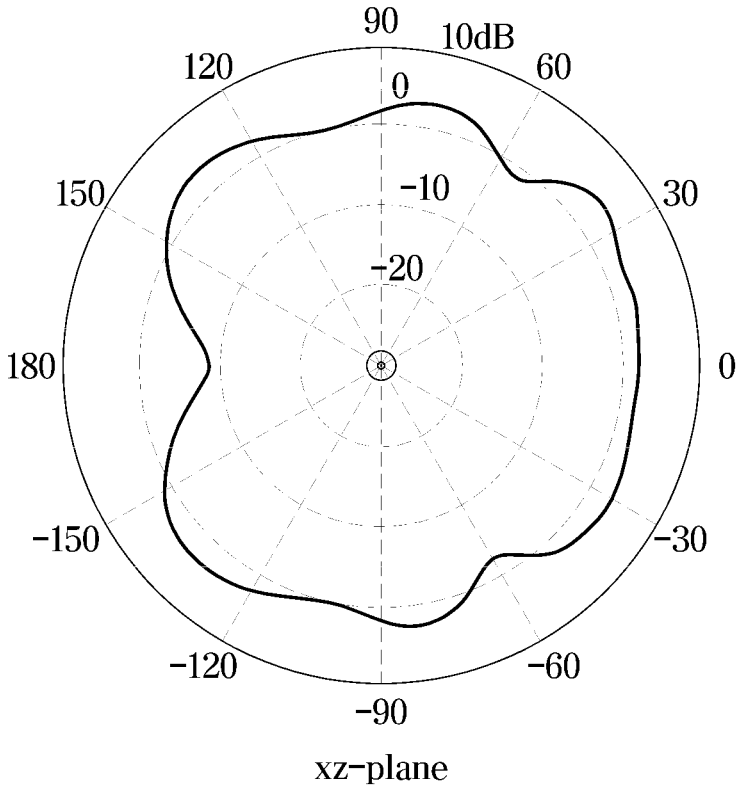

FIGS. 9 and 10 are graphs illustrating radiation patterns of the antenna 100 when operating at a frequency of 625 MHz. Specifically, FIG. 9 illustrates a radiation pattern along the xy plane indicated in FIG. 5, and FIG. 10 illustrates a radiation pattern along the xz plane indicated in FIG. 5. The antenna 100 according to an embodiment of the present disclosure may have a radiation pattern directing to all directions (i.e., all directions from 0 to 360 degrees).

Figure 11:
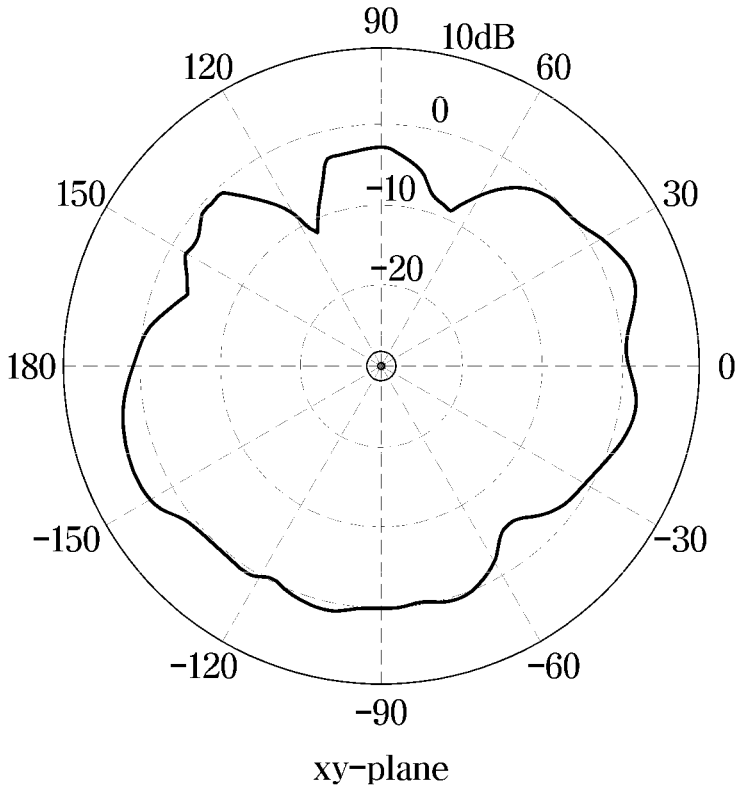
Figure 12:
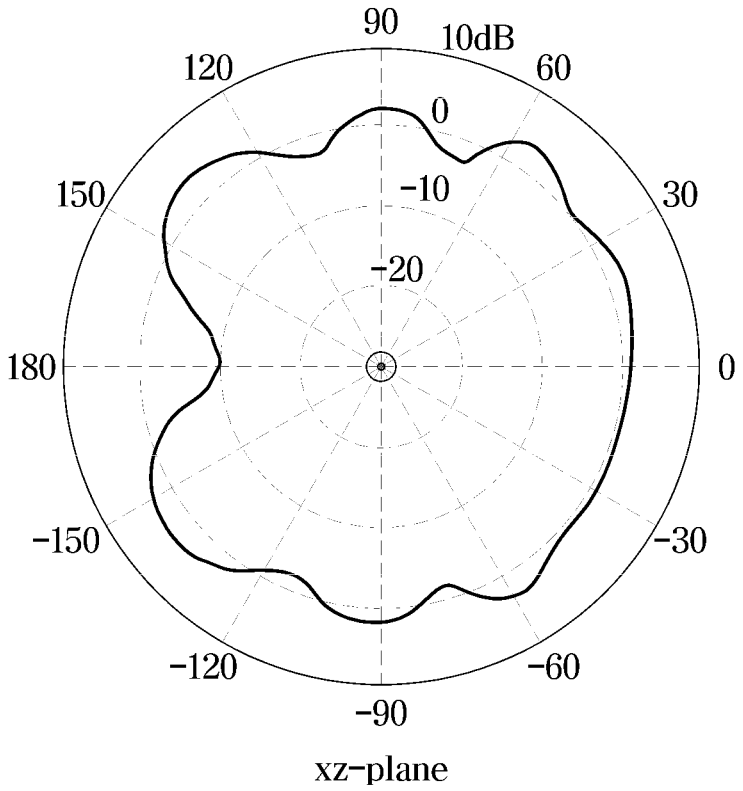

FIGS. 11 and 12 are graphs illustrating radiation patterns of the antenna 100 when operating at a frequency of 771 MHz. Specifically, FIG. 11 illustrates a radiation pattern along the xy plane indicated in FIG. 5, and FIG. 12 illustrates a radiation pattern along the xz plane indicated in FIG. 5. The antenna 100 according to an embodiment of the present disclosure may have a radiation pattern directing to all directions (i.e., all directions from 0 to 360 degrees).

Figure 13:
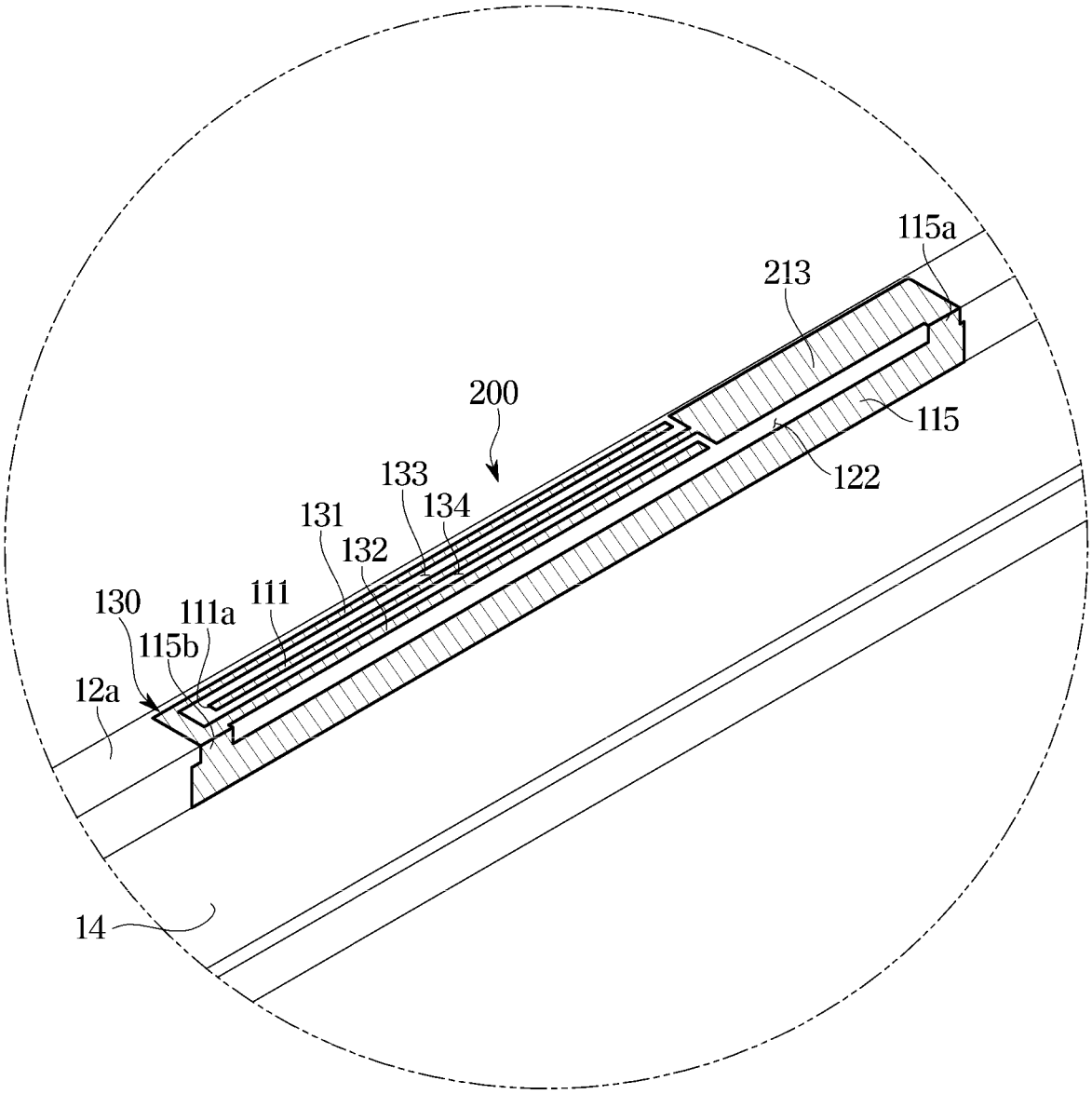
FIG. 13 is a rear view of an antenna according to another embodiment of the present disclosure.
Figure 14:
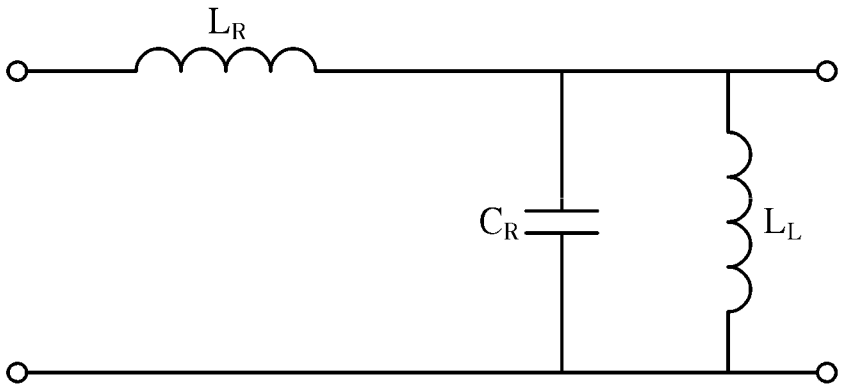
FIG. 14 is a circuit diagram illustrating an equivalent circuit of the antenna illustrated in FIG. 13.
Figure 15:
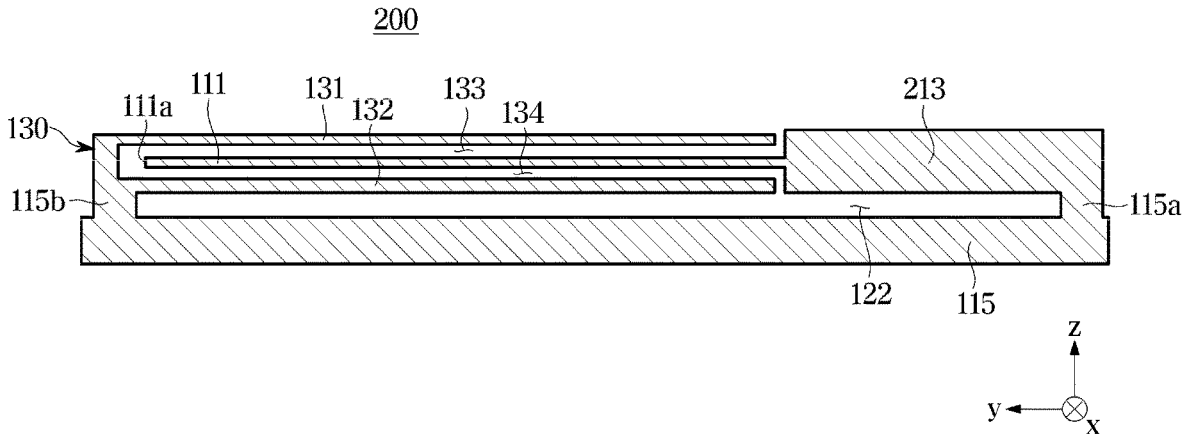
FIG. 15 is a plan view of the antenna in an unfolded state illustrated in FIG. 13.

FIG. 13 is a rear view of an antenna according to another embodiment of the present disclosure. FIG. 14 is a circuit diagram illustrating an equivalent circuit of the antenna illustrated in FIG. 13. FIG. 15 is a plan view of the antenna in an unfolded state illustrated in FIG. 13.

An antenna 200 according to another embodiment of the present disclosure will be described below with reference to FIGS. 13 to 15. The same reference numerals will be assigned to the same components as those in the above-described embodiment, and description thereof may be omitted.

Referring to FIGS. 13 to 15, in the antenna 200 according to another embodiment of the present disclosure, the series capacitor $C_L$ illustrated in FIGS. 3 to 5 may be omitted.

Specifically, the antenna 200 may include the feeding body 111, a radiation body 213, and the ground body 115. The antenna 200 may further include the broadband member 130. Because the feeding body 111, the ground body 115, and the broadband member 130 have the same configuration as in the embodiment illustrated in FIGS. 3 to 5, a detailed description thereof will be omitted.

Unlike the embodiment illustrated in FIGS. 3 to 5 in which the radiation body 113 is composed of the first radiation body 113 and the second radiation body 114 spaced apart from the first radiation body 113, in the embodiment illustrated in FIGS. 13 to 15, the antenna 200 may include the radiation body 213 configured as a single body.

Unlike the antenna 100 illustrated in FIGS. 3 to 5, the series capacitor $C_L$ is omitted in the antenna 200 illustrated in FIGS. 13 to 15, but the antenna 200 may have both the LH characteristic and the RH characteristic similar to the antenna 100 illustrated in FIGS. 3 to 5. That is, the antenna 200 illustrated in FIGS. 13 to 15 may implement broadband characteristics using a transmission line having the CRLH structure like the antenna 100 illustrated in FIGS. 3 to 5.

Figure 16:
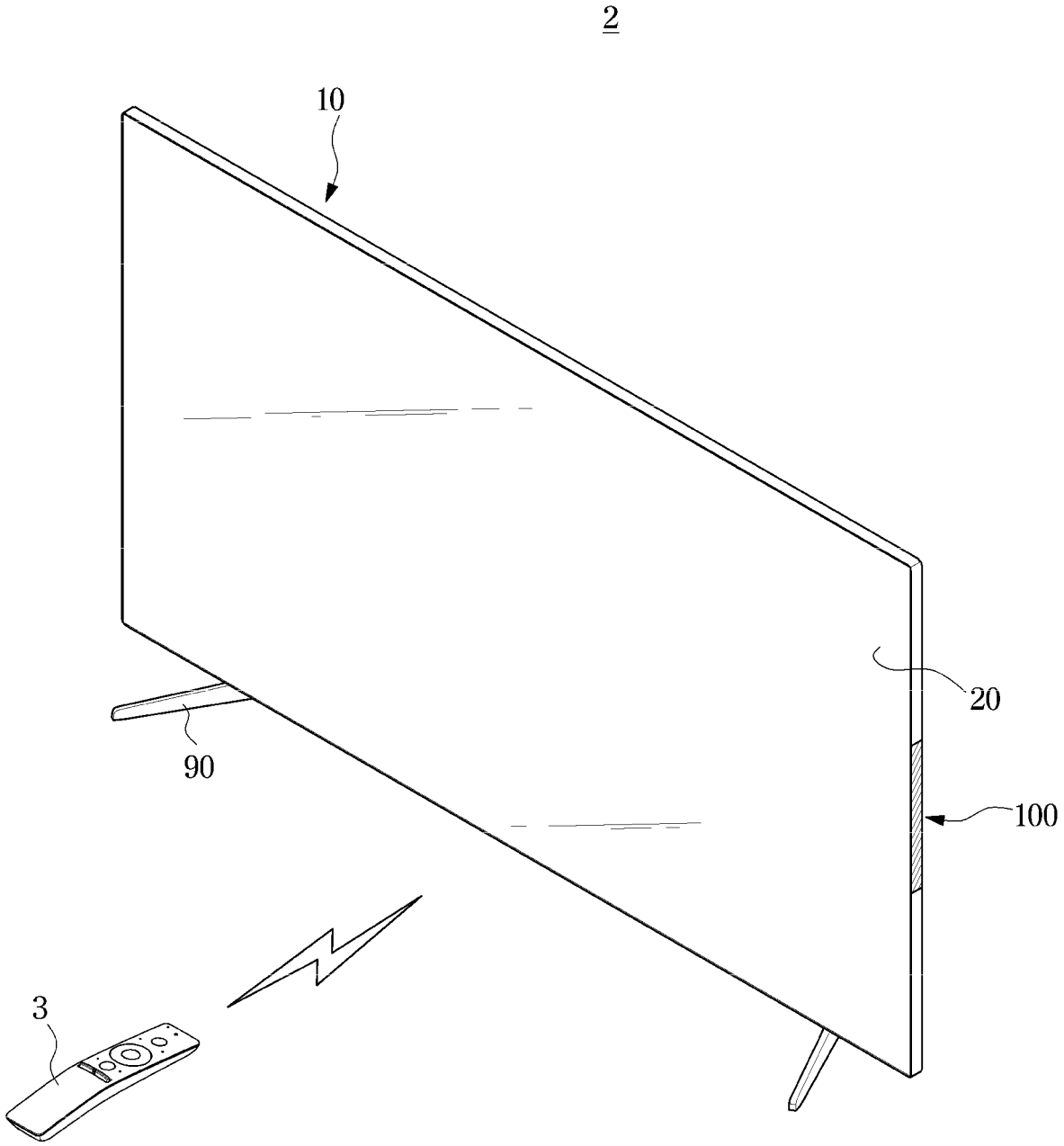
FIG. 16 illustrates an outer appearance of a display apparatus according to another embodiment of the present disclosure.

FIG. 16 illustrates an outer appearance of a display apparatus according to another embodiment of the present disclosure.

A display apparatus 2 according to another embodiment of the present disclosure will be described below with reference to FIG. 16. The same reference numerals will be assigned to the same components as those in the above-described embodiment, and description thereof may be omitted.

The display apparatus 2 may include the antenna 100 configured to operate at the entire frequencies of the UHF broadcast band. The antenna 100 may have the same configuration as the antenna 100 illustrated in FIGS. 3 to 5.

The antenna 100 may be disposed on one side of the main body 10 of the display apparatus 2. FIG. 16 illustrates that the antenna 100 is disposed on the right side of the main body 10, but unlike this, the antenna 100 may be disposed on the left side of the main body 10 and may be disposed on both the left side and the right side of the main body 10.

For convenience of explanation, the display apparatus 2 has been described as having the antennas illustrated in FIGS. 3 to 5, but unlike this, the display apparatus 2 may have the antenna 200 illustrated in FIGS. 13 to 15.

While the present disclosure has been particularly described with reference to exemplary embodiments, it should be understood by those of skilled in the art that various changes in form and details may be made without departing from the spirit and scope of the present disclosure.

The invention claimed is:

1. A display apparatus comprising:

a display panel;

a bezel surface formed on a boundary of the display panel; and an antenna located on the bezel surface, wherein the antenna comprises:

a waveguide structure including a feeding body, a composite right left handed (CRLH) structure comprising a series inductor provided in the feeding body, a series capacitor, a parallel inductor, and a parallel capacitor, a first radiation body, and a second radiation body spaced apart from the first radiation body by a first gap configured to form a series capacitance by the series capacitor, wherein the first radiation body and the second radiation body are configured to transmit and receive radio waves.

2. The display apparatus according to claim 1, further comprising a bottom chassis configured to cover the rear of the display panel, wherein the antenna comprises a ground body connected to the bottom chassis.

3. The display apparatus according to claim 2, wherein the bottom chassis comprises a metal.

4. The display apparatus according to claim 2, wherein:

the ground body comprises a first ground portion connected to the second radiation body; and the parallel inductor is provided in the first ground portion.

5. The display apparatus according to claim 2, wherein the first radiation body is connected to the feeding body.

6. The display apparatus according to claim 2, wherein:

the first radiation body and the second radiation body are disposed to be spaced apart from the ground body by a second gap; and the second gap is configured to form a parallel capacitance by the parallel capacitor.

7. The display apparatus according to claim 2, wherein:

the antenna further comprises a broadband member disposed on the same plane as the feeding body; and the broadband member comprises a first coplanar waveguide (CPW) body disposed on one side of the feeding body to be spaced apart by a third gap, and a second CPW body disposed on the other side opposite to one side of the feeding body to be spaced apart by a fourth gap.

8. The display apparatus according to claim 7, wherein the first CPW body and the second CPW body extend in the same direction as the feeding body.

9. The display apparatus according to claim 7, wherein the ground body comprises a second ground portion connected to the broadband member.

10. The display apparatus according to claim 1, wherein at least a portion of the antenna is located on at least one of an upper surface, a left surface, and a right surface of the bezel surface.

11. The display apparatus according to claim 3claim 1, wherein the feeding body, the first radiation body, and the second radiation body are configured to be disposed on the same surface as the bezel surface.

* * * * *